United States Patent [19]

Koyama et al.

[11] 4,358,532

[45] Nov. 9, 1982

[54] PHOTOGRAPHIC ELEMENT

[75] Inventors: Koichi Koyama; Shinsaku Fujita, both of Minami-ashigara, Japan

[73] Assignee: Fuji Photo Film Co., Ltd., Kanagawa, Japan

[21] Appl. No.: 283,412

[22] Filed: Jul. 15, 1981

[30] Foreign Application Priority Data

Jul. 15, 1980 [JP] Japan ..... 55-96339

[51] Int. Cl.[3] ..... G03C 1/40; G03C 1/10; G03C 5/54; G03C 7/00

[52] U.S. Cl. ..... 430/505; 430/222; 430/223; 430/542; 430/543; 430/559; 430/561; 430/562; 430/564; 430/566; 430/570; 430/598; 430/599; 430/606; 430/607; 430/621; 430/955; 430/957; 430/958; 430/960; 430/959

[58] Field of Search ..... 430/222, 223, 226, 541, 430/543, 558, 552, 559, 542, 561, 562, 563, 505, 564, 566, 570, 598, 599, 606, 607, 621, 955, 957, 958, 960, 959, 956

[56] References Cited

U.S. PATENT DOCUMENTS

| | | | |
|---|---|---|---|
| 3,443,940 | 5/1969 | Bloom et al. | 430/223 |
| 3,980,479 | 9/1976 | Fields et al. | 430/222 |
| 4,110,113 | 8/1978 | Melzer et al. | 430/223 |
| 4,258,120 | 3/1981 | Gerbal et al. | 430/223 |

*Primary Examiner*—Richard L. Schilling
*Attorney, Agent, or Firm*—Sughrue, Mion, Zinn, Macpeak and Seas

[57] ABSTRACT

A photographic element containing a compound represented by formula (I)

(I)

wherein G represents —$OR^1$ or —$NHR^2$, $R^1$ represents hydrogen or a hydrolyzable moiety, $R^2$ represents hydrogen or an alkyl group containing from 1 to 50 carbon atoms, Z represents a photographically useful group, A represents an atomic group forming an aromatic ring, Ball represents an organic immobilizing group on the aromatic ring, which cntains from 8 to 50 carbon atoms, m represents an integer of 1 or 2, X represents a divalent organic group, Nu represents a nucleophilic group, and n represents an integer of 1 or 2, and X with the nucleophilic group Nu is capable of forming a 5- to 12-membered ring by oxidation having an electrophilic center at the carbon atom substituted by the —$NHSO_2Z$ group.

13 Claims, No Drawings

PHOTOGRAPHIC ELEMENT

FIELD OF THE INVENTION

This invention relates to photography and, more particularly, to a photographic element containing a novel compound.

From another aspect, the present invention relates to novel compounds for use in photographic elements, i.e., non-diffusible sulfonamidoaniline or sulfonamidophenol derivatives capable of rapidly releasing a diffusible photographically useful group by oxidation and simultaneous or subsequent action of an intramolecular nucleophilic group, and to a process for releasing a photographically useful group, particularly a dye, as a function of silver halide development.

BACKGROUND OF THE INVENTION

It is known in the photographic field to use image dye-providing compounds in photographic elements, such as image transfer type film units. For example, illustrative diffusible color couplers are described in U.S. Pat. No. 2,698,244, granted to Land. With such couplers, dyes are synthesized in an image-receiving layer. U.S. Pat. No. 2,774,668 discloses use of mobile dyes previously-formed by reaction of a coupler with a mobile oxidized color developer. Another disclosure as to the use of a mobile previously-formed dye is found in U.S. Pat. No. 2,983,606, granted to Rogers. However, initially mobile image dye-providing compounds cause some disadvantages when used in a photographic element. Particularly, in such photographic elements, diffusion into an adjacent layer is in some cases so fast that detrimental influences result on the interimage effect and color reproduction.

Image dye-providing compounds which are initially immobile in a photographic element, i.e., stabilized image dye-providing compounds, solve various problems encountered in the case of using initially mobile compounds. These dye-providing compounds may be temporarily stabilized by using a heavy metal counter ion such as barium salt disclosed in U.S. Pat. No. 2,756,142, granted to Yutzy. They may contain a removable ballast group, as described in Whitmore's Canadian Pat. No. 602,607, and U.S. Pat. Nos. 3,227,552, 3,628,952, 3,728,113, 3,725,062, etc. U.S. Pat. Nos. 3,443,939, 3,443,940, 3,443,941, and 3,751,406 disclose compounds capable of undergoing intramolecular cyclization by oxidation to split off a dye. These compounds undergo an oxidative cyclization reaction during the development processing to split off an "initially formed dye moiety". Such compounds can be classified into two groups. Compounds belonging to one group are those for which an ordinary color developer is used in development processing, i.e., which undergo coupling reaction with an oxidation product of the above-described color developer to split off a diffusible "initially formed dye moiety" by the subsequent ring-closing reaction. Compounds belonging to another group are those which constitute a silver halide-developing agent, and undergo a ring-closing reaction in the absence of other developing compounds to split off a diffusible dye. However, this second diffusible dye is split off in a form containing a sulfinic acid group. This sulfinic acid group is comparatively chemically active, and causes chemical action with various additives or silver halide in a photographic element to exert detrimental influences on the final image.

Japanese Patent Application (OPI) No. 33826/73 (Fleckenstein et al) discloses immobile compounds which undergo redox reaction and then alkali cleavage to release a dye, and Japanese Patent Application (OPI) No. 113624/76 (Koyama et al) discloses other immobile compounds capable of releasing a dye based on the same mechanism. However, these image dye-providing compounds split off diffusible dyes where they undergo oxidation reaction, and hence the use of a direct positive silver halide emulsion or other reversal mechanism is required for obtaining a direct positive image. In addition, a serious defect with this system is that the two processes of oxidation and alkali hydrolysis must be conducted before release of the dye, resulting in a seriously prolonged image-completing time.

Attempts to directly obtain a positive image by using a negative emulsion are disclosed in Japanese Patent Application (OPI) Nos. 111628/74 and 4819/77 (Hinshaw et al) and Japanese Patent Application (OPI) No. 63618/76 (Field et al).

The compounds described in the above-described patents are immobile, and they release, in a reduced state, a diffusible, photographically useful group by intramolecular nucleophilic reaction in the presence of alkali. These compounds can be oxidized by redox reaction in a photographic element, and, as a result, the rate of splitting off of the photographically useful group may be substantially decreased.

The compounds described in the above patents can overcome many defects which are inherent in conventional initially-immobile compounds. However, there still exists many problems of fogging and deterioration of discrimination due to the timing lag between oxidation and alkali hydrolysis (which are in competitive relation with each other in the photographic element), poor diffusibility of released dyes due to the absence of water-soluble groups in released dyes, elimination of mordanted dye, etc.

SUMMARY OF THE INVENTION

An object of the present invention is to provide novel, diffusion-resistant (immobile) compounds capable of providing a photographically useful group, and photographic elements containing such compounds.

Another object of the present invention is to provide novel, diffusion-resistant compounds having sufficiently fast reaction rates, sufficient stability, good color transfer properties, and high dye-releasiang efficiency, and which are capable of providing a dye which forms an image in an extremely short time, and photographic elements containing such compounds.

A further object of the present invention is to provide a process for forming a dye image using such a photographic element.

The objects of the present invention are achieved through the use in photographic elements of a new compound represented by formula (I)

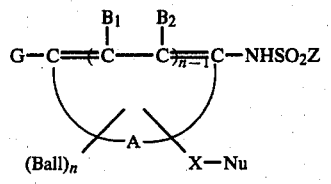

(I)

wherein G, Z, A, Ball, X, Nu, $B_1$, $B_2$ and n are as defined below.

A photographic element according to the present invention comprises a support having provided thereon at least one light-sensitive silver halide emulsion layer, said silver halide emulsion layer containing an essentially immobile, sulfonamido group- and nucleophilic group-containing compound in which a photographically useful group is linked via a sulfonamido bond (hereinafter more simply referred to as the "sulfonamido compound"), i.e., a sulfonamidophenol compound or a sulfonamidonaphthol compound. In a particularly preferable embodiment, the above-described sulfonamido compounds of the present invention are decomposed by oxidation under the influence of the intramolecular nucleophilic group to release the diffusible, photographically useful group from the aromatic nucleus.

Preferably, the present invention relates to a photographic element comprising a support having provided thereon a red-sensitive silver halide emulsion-containing layer associated with a sulfonamidonaphthol compound having a cyan image-providing moiety and an intramolecular nucleophilic group, a green-sensitive silver halide emulsion-containing layer associated with a sulfonamidonaphthol compound having a magenta image-providing moiety and an intramolecular nucleophilic group, and a blue-sensitive silver halide emulsion-containing layer associated with a sulfonamidophenol compound having a yellow image-forming moiety and an intramolecular nucleophilic group.

DETAILED DESCRIPTION OF THE INVENTION

In the case of using the sulfonamido compounds of the present invention in a photographic element, the photographically useful group is particularly preferably a dye image-providing material such as a dye or a dye precursor. One preferable diffusion transfer photographic process comprises the following steps:

(1) a step of processing a photographic element prepared according to the present invention with an alkaline processing composition in the presence of a silver halide-developing agent for conducting development of the respective exposed silver halide emulsion layers to thereby oxidize the above-described developing agent;

(2) a step of cross-oxidizing the respective sulfonamido compounds with the oxidized developing agent;

(3) a step of decomposing the respective crossoxidized sulfonamido compounds with the intramolecular nucleophilic group, thus forming diffusing dye components in comformity with the original image as a result of imagewise exposure of the respective silver halide emulsion layers; and (4) a step of transferring at least part of the diffusible dyes having a distribution in conformity with the original image to a dye image-receiving layer to form an image there.

The above-described sulfonamido compounds (also referred herein as the "immobile compounds") can be represented by formula (I);

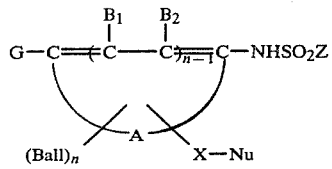

(I)

wherein G represents $OR^1$ or $NHR^2$, $R^1$ represents hydrogen or a hydrolyzable moiety (e.g., an acetyl group, a propionyl group, a benzoyl group, a p-nitrobenzoyl group, a phenoxycarbonyl group, or a m-nitrophenoxycarbonyl group), $R^2$ represents hydrogen or an alkyl group containing from 1 to 50, preferably from 1 to 18, carbon atoms (for example, a methyl group, an ethyl group, a propyl group, a butyl group, an octyl group, a lauryl group or a hexadecyl group); Z represents a photographically useful group, for example, an image dye-providing moiety or a photographic reagent moiety (e.g., a bleaching-accelerator, a bleaching-restrainer, a developing agent, a silver halide solvent, a fixing agent, a toner, a hardening agent, a chemical sensitizing agent, a spectral sensitizing agent, an antifogging agent, a development restrainer, a development accelerator, a silver halide-fogging agent (nucleating agent), or the like); A represents atoms necessary for forming an aromatic ring, such as a benzene ring, a naphthalene ring, or a hetero ring (said atoms comprising carbon atoms, nitrogen atoms and/or oxygen atoms; typical but non-limiting examples of said hetero ring include an indole ring, a carbazole ring, a benzofuran ring, a dibenzofuran ring, a phenothiazine ring, and a phenoxazine ring); Ball represents an organic immobilizing group (ballast group) present on the aromatic ring (benzene ring, naphthalene ring, hetero ring, or the like), with at least one of said immobilizing groups containing from 8 to 50, and preferably from 8 to 22, carbon atoms, and, when two Ball groups exist, they may be the same or different from each other; m represents an integer of 1 or 2; A may have other substituents in addition to said organic immobilizing groups, such as an alkyl group (e.g., a methyl group, an ethyl group, a propyl group, an isopropyl group, a n-butyl group, an iso-butyl group, a sec-butyl group, a t-butyl group, a n-hexyl group, a cyclohexyl group, etc.), an alkoxy group or substituted alkoxy group (e.g., a methoxy group, an ethoxy group, a propyloxy group, a methoxyethoxy group, an ethoxyethoxy group, etc.), an acylamino group (e.g., an acetylamino group, a propionylamino group, a p-nitrobenzoylamino group, etc.), a carbamoyl group (e.g., a methylcarbamoyl group, an ethyl carbamoyl group, etc.), a sulfonamido group (e.g., a methanesulfonamido group, a toluenesulfonamido group, etc.), a sulfamoyl group (e.g., a methylsulfamoyl group, a butylsulfamoyl group, etc.), an acyl group (e.g., an acetyl group, a propionyl group, etc.), a nitro group, a cyano group, or a halogen atom (e.g., a chlorine atom, a bromine atom, etc.); X represents a divalent organic group containing from 1 to 8 linking atoms, such as a $C_1$–$C_8$ methylene group, an oxamethylene group, an aminomethylene group, a sulfonyl group, a carbonyl group, an amido group, a carbamoyl group, a sulfonamido group, a sulfamoyl group, a phenylene group or the like, and X together with the nucleophilic group Nu and the carbon atom to which the —$NHSO_2Z$ group is attached, is capable of forming a 5- to 12-, preferably a 5- to 8-, and more preferably a 5- to 6-, membered ring having an electrophilic center at the carbon atom substituted by the —$NHSO_2Z$ group, which is produced by oxidation in, for example, development processing; Nu represents a nucleophilic group selected from among a hydroxy group, an amino group, a carboxylic acid group, a sulfonic acid group, and the precursors thereof (for example, acyl or ester derivatives thereof), $B_1$ and $B_2$ each represents hydrogen or a substituent selected from the group consisting of an alkyl group containing from 1 to 7 carbon atoms; with the aromatic ring completed by A being substituted with only one X-Nu; and n represents an integer of 1 or 2.

Specific examples of the alkyl group containing from 1 to 7 carbon atoms include a methyl group, an ethyl group, a propyl group, an isopropyl group, an n-butyl group, an iso-butyl group, a sec-butyl group, a t-butyl group, an n-hexyl group, a cyclohexyl group, etc.

The ballast group represented by Ball is preferably a hydrophobic group containing from 8 to 50, and preferably from 8 to 22, carbon atoms. Such ballast group is bound to the immobile compound of the present invention directly or through a linking group (e.g., an imino bond, ether bond, thioether bond, carbonamido bond, sulfonamido bond, ureido bond, ester bond, imido bond, carbamoyl bond, sulfamoyl bond, and the combination thereof).

Specific examples of the ballast group include: alkyl groups and alkenyl groups (e.g., a dodecyl group, an octadecyl group, etc.) a alkoxyalkyl groups (e.g., a 3-(octyloxy)propyl group and 3-(2-ethylundecyloxy)-propyl group as described in Japanese Patent Publication No. 27563/64), alkylaryl groups (e.g., a 4-nonylphenyl group, a 2,4-di-tert-butylphenyl group, etc.), alkylaryloxyalkyl groups (e.g., a 2,4-di-tert-pentylphenoxymethyl group, an α-(2,4-di-tert-pentylphenoxy)propyl group, a 1-(3-pentadecylphenoxy)ethyl group, etc.), acylamidoalkyl groups (e.g., those described in U.S. Pat. Nos. 3,337,344 and 3,418,129, a 2-(N-butylhexadecanamido)ethyl group, etc.), alkoxyaryl and aryloxyaryl groups (e.g., a 4-(n-octadecyloxy)phenyl group, a 4-(4-n-dodecylphenyloxyphenyl group, etc.), residues containing an alkyl or alkenyl long-chain aliphatic group and a water-solubilizing group such as carboxyl or sulfo group (e.g., a 1-carboxymethyl-2-nonanedecenyl group, a 1-sulfoheptadecyl group, etc.), ester-substituted alkyl groups (e.g., a 1-ethoxycarbonylheptadecyl group, a 2-(n-dodecyloxycarbonyl)ethyl group, etc.), aryl or hetero ring-substituted alkyl groups (e.g., a 2-[4-(3-methoxycarbonylheneicosanamido)phenyl]ethyl group, a 2-[4-(2-n-octadecylsuccinimido)phenyl]ethyl group, etc.), and aryloxyalkoxycarbonyl-substituted aryl groups (e.g., a 4-[2-(2,4-di-tertpentylphenoxy)-2-methylpropyloxycarbonyl]phenyl group, etc.).

Of the above-described organic ballast groups, particularly preferable are those which are bound to a linking group as shown in the following formulae;

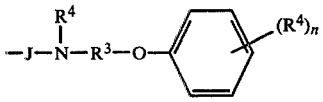

$$-J-\overset{R^4}{\overset{|}{N}}-R^3-O-R^5$$

$$-J-\overset{R^4}{\overset{|}{N}}-R^6$$

-continued $$-J-N(R^6)_2$$

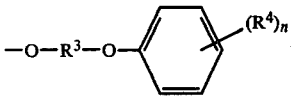

$$-O-R^3-O-R^5$$

$$-O-R^6$$

wherein J represents —CO— or —$SO_2$—, $R^3$ represents an alkylene group containing from 1 to 10, and preferably from 1 to 6, carbon atoms (e.g., a propylene group or a butylene group), $R^4$ (which may be the same as or different from each other when more than one $R^4$ is present) represents hydrogen or an alkyl group containing from 1 to 30, and preferably from 1 to 20, carbon atoms (e.g., a tert-amyl group or a n-pentadecyl group), n represents an integer of 1 to 5 (preferably 1 or 2), $R^5$ represents an alkyl group containing from 4 to 30, and preferably from 10 to 20, carbon atoms (e.g., a dodecyl group, a tetradecyl group or a hexadecyl group), and $R^6$ represents an unsubstituted alkyl group containing from 8 to 30, and preferably from 10 to 20, carbon atoms (e.g., a hexadecyl group or an octadecyl group) or a substituted alkyl group containing in total 8 or more carbon atoms (the alkyl moiety containing 1 or more carbon atoms; the substituent being exemplified by a carbamoyl group, sulfamoyl group, carboxamido, sulfonamido, etc.).

The most preferable examples of the immobile compounds of the present invention are aminonaphthol compounds and aminophenol compounds represented by the following formulae (II) and (III), respectively, to which the photographically useful group, such as a dye or a dye precursor, is bound.

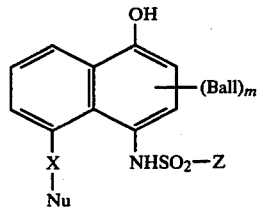

(II)

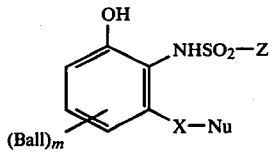

(III)

In the above formulae, Z, X, Nu, Ball, and m are the same as defined for formula (I).

While not intending to limit the reaction mechanism of the present invention by a particular theory or mechanism, it is believed that the chemical reaction of the present invention takes place according to the following simplified scheme.

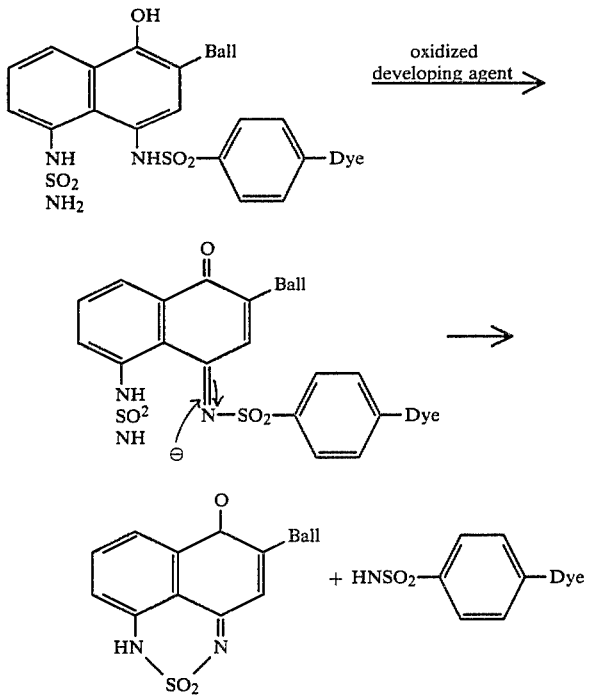

In the present invention, when the redox portion of the compound is oxidized, the nucleophilic group, such as an amino group, rapidly attacks the electrophilic center produced by the oxidation and, as a result, the photographically useful moiety such as dye is split off as a sulfonamido derivative having an extremely high diffusibility and showing excellent mordantability. On the other hand, when no oxidation takes place, the nucleophilic group cannot attack the target, and thus the dye is not split off.

The effects obtained by the immobile compounds of the present invention are principally due to the intramolecular nucleophilic reaction and, as compared with conventional compounds utilizing an intermolecular nucleophilic reaction, the compounds of the present invention provide the following advantages:

(1) An image can be formed in a shorter time due to the fast dye-releasing rate.

(2) Since the dye is split off even at a low pH, image density ($D_{max}$) is scarcely influenced by the rate of decrease in pH in the film unit.

(3) Thus, a low amount of an oxidation product remains in the negative layer, and hence there is no unfavorable increase in dye density after completion of image.

The compounds of the present invention have further advantages as follows as compared with conventional compounds:

(4) The presence of a photographically inert sulfonamido group in the dye to be split off from the compounds of the present invention are advantageous with respect to color reproduction as compared with conventional, sulfinic acid-releasing compounds.

(5) Since the released dyes necessarily possess a sulfonamido group, they show better diffusibility and mordantability as compared with those released from conventional compounds in the form of having a terminal amino group.

(6) In the compounds of the present invention, the electrophilic center is produced only when they are oxidized, and hence they cause less fogging and provide better discrimination than conventional ones wherein an electrophilic center initially exists (described in the foregoing patents granted to Hinshaw et al and Field et al).

Typical examples of the immoble compounds of the present invention are illustrated below.

(1)

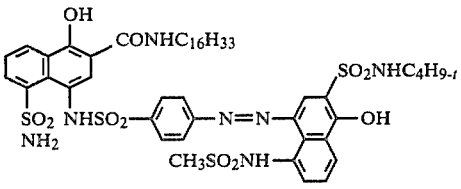

(2)

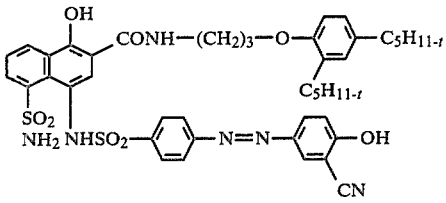

(3)

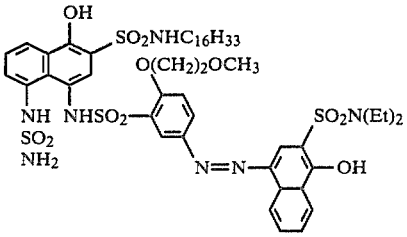

(4)

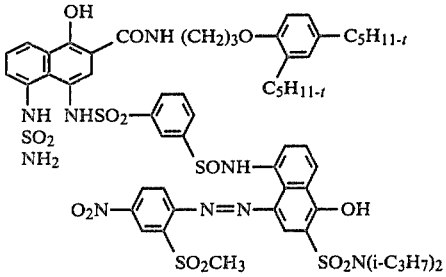

(5)

(6)

-continued
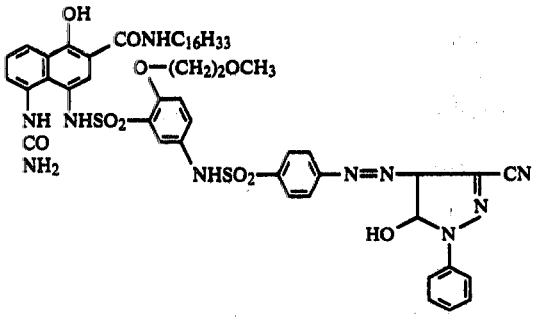
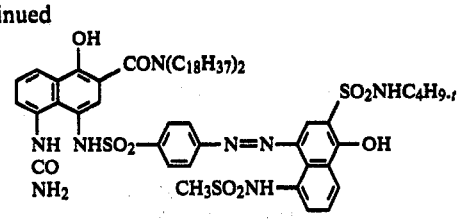
(7)
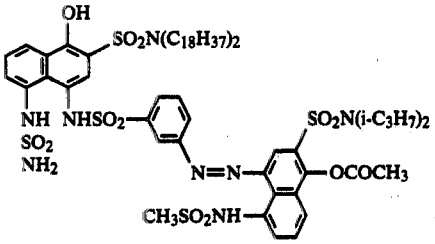
(8)
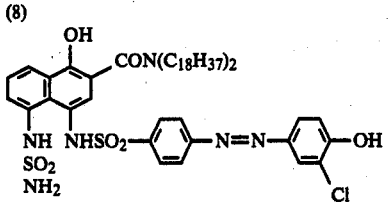
(9)
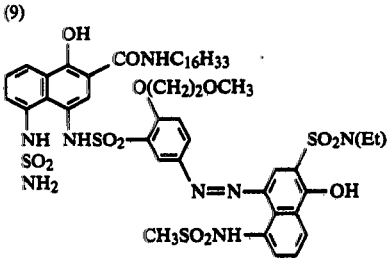
(10)
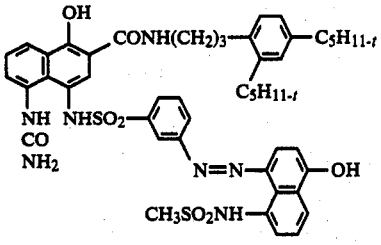
(11)
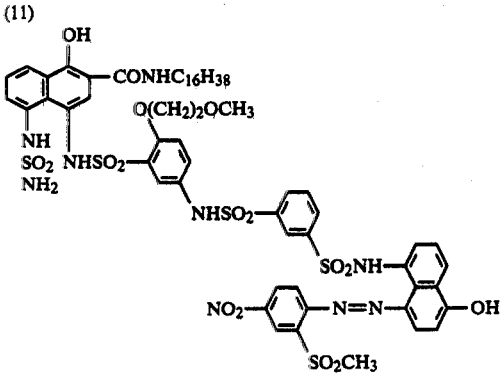
(12)
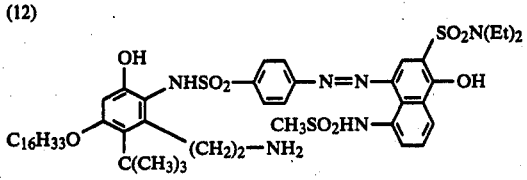
(13)
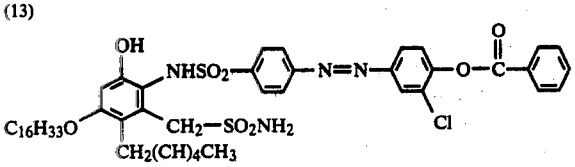
(14)
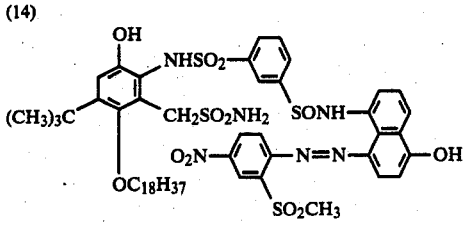
(15)
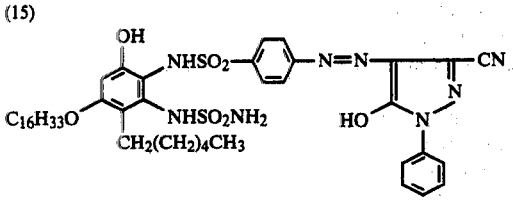
(16)
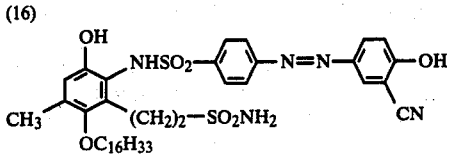

(17)

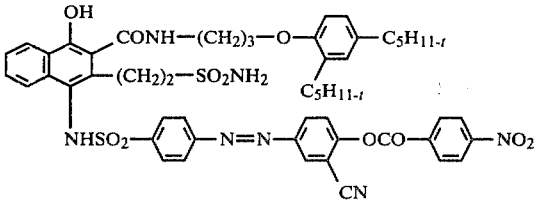

-continued (18)

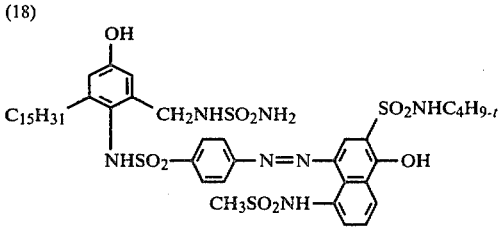

(19)

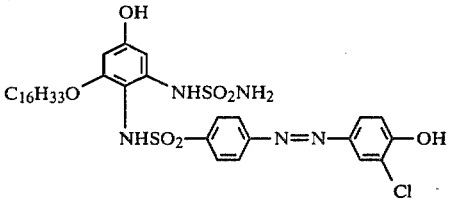

Of the above-illustrated compounds, compounds (1) through (8) provide particularly good results.

The immobile compounds of the present invention are typically used alone, but they may also be used in combinations of two or more.

The immobile compounds of the present invention is associated with a light-sensitive emulsion to constitute a light-sensitive material. Upon processing such light-sensitive material after imagewise exposure, the immobile compound of the present invention present in portions where silver development takes place is oxidized and in turn releases a dye as a result of an intramolecular nucleophilic reaction. The light-sensitive material from which the dye has been transferred to another element or washed away with water may be subjected to the photographic processings of bleaching, fixing, etc. to thereby obtain a color image. When a so-called ordinary emulsion is used which undergoes development in proportion to exposure amount, the transferred image forms a negative image and the remaining image forms a positive image. On the other hand, when a direct reversal emulsion, DIR reversal emulsion system as described in U.S. Pat. Nos. 3,227,551, 3,227,554 and 3,364,022, or reversal emulsion system using solution physical development as described in British Pat. No. 904,364 is used, the transferred image forms a positive image, while the remaining image forms a negative image. Either one image or either combination of the negative and positive images can be utilized, depending upon the end-use purpose.

Development processing of the light-sensitive material described above is desirably conducted in the presence of an auxiliary developing agent so as to permit electrons to smoothly transfer between the color image-forming agent and silver halide grains. Examples of auxiliary developing agent that can be used include, for example, the following: pyrazolidinones (e.g., 1-phenyl-3-pyrazolidinone, 1-phenyl-4,4-dimethyl-3-pyrazolidinone, 1-phenyl-4-methyl-3-pyrazoidinone, 1-phenyl-4-hydroxymethyl-4-methyl-3-pyrazolidinone, 1p-tolyl-4-hydroxymethyl-4-methyl-3-pyrazolidinone, etc.), p-aminophenol, N-methyl-p-aminophenol, N,N-diethylaminophenol, p-tolylhydroquinone, N,N-diethyl-p-phenylenediamine, and 6-hydroxy-1,2,3,4-tetrahydroquinoline.

Of these, black-and-white developing agents are particularly preferably used as auxiliary developing agents for decreasing stain detrimentally influencing photographic images.

Of black-and-white developing agents, pyrazolidinones are particularly suitable to be used in combination with the compounds of the present invention. In particular, combinations of the immobile compounds of the present invention and 1-phenyl-3-pyrazolidone series developing agents having the following structural formulae are advantageous.

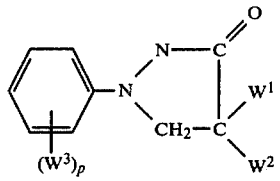

In the above general formula, $W^1$ and $W^2$ may be the same as or different from each other, and each represents hydrogen, an alkyl group (e.g., a methyl group, an ethyl group, etc.), or a hydroxyalkyl group (e.g., a hydroxymethyl group, a hydroxyethyl group, etc.), $W^3$ represents hydrogen or a substituent having a negative Hammett's $\sigma$ value, and p represents an integer of 1 to 5.

As specific examples of the substituent $W^3$, there are illustrated in alkyl group (e.g., a methyl group, an ethyl group, etc.), an alkoxy group (e.g., a methoxy group, an ethoxy group, etc.), a hydroxy group, an amino group, and an aryl group (e.g., a phenyl group, etc.). When p represents 2, the substituent $W^3$ can be exemplified by a methyl group. Of these compounds, those which have a half wave potential (measured by polarography) between about $-80$ mV and $-200$ mV (reference electrode: standard calomel electrode; pH=11.0), preferably between $-100$ mV and $-150$ mV, are particularly useful in that they can cause rapid development of emulsion grains and active cross-oxidation reaction with the immobile compound of the present invention and can therefore shorten the time for image completion.

In utilizing a compound of the present invention for a diffusion transfer process, an embodiment using a hydroquinone (e.g., hydroquinone, t-butylhydroquinone, etc.) in combination with the developing agent of pyrazolidinone described above is advantageous for adjusting gradation in toe portions.

In general, the immobile compound of the present invention is dispersed in a hydrophilic colloid carrier by the following process. That is, a solution obtained by dissolving the immobile compound of the present invention in an organic solvent is added to a hydrophilic colloid solution and dispersed therein as fine droplets. Volatile solvents such as ethyl acetate, tetrahydrofuran, or methyl ethyl ketone can be removed in the step of drying photographic layers or by the methods described in U.S. Pat. No. 2,322,027 or 2,801,171, whereas solvents readily soluble in water, such as dimethylformamide or 2-methoxyethanol, can be washed away with water according to the method described in U.S. Pat. No. 2,949,360 or 3,396,027. However, in order to stabilize the dispersion of the immobile compound of the present invention and accelerate the dye image-forming step, it is advantageous to incorporate the immobile compound of the present invention in a solvent which is substantially insoluble in water and which has a boiling point of 200° C. or higher under atmospheric pressure. Examples of such solvents include dibutyl phthalate, tricresyl phosphate, trihexyl phosphate, tricyclohexyl phosphate, N,N-diethyllaurylamide, etc. For accelerating the step of dissolving the dye-releasing redox compound, it is desirable to auxiliarily use the above-described volatile or water-soluble solvents.

Further, an oleophilic polymer may be used in place of, or in addition to, the above-described high-boiling solvent.

As such polymer, there can be used, for example, a polyester resin obtained by polycondensation of polyhydric alcohol and polybasic acid. Also, there can be used other polymers such as polyvinyl pyrrolidone, polyvinyl acetate, polyvinyl propionate, polyvinyl butyral, polyvinyl chloride, polyacrylic ester, polymethacrylic ester, nitrocarboxymethyl cellulose, N-vinylpyrrolidone-acrylic acid copolymer, N-vinylpyrrolidone-acrylic acid-methyl acrylate terpolymer, vinylphthalimide-acrylic acid copolymer, cellulose acetate hydrogen phthalate, poly-N-methylmethacrylamide, dimethylaminoethyl methacrylate-acrylic acid copolymer, etc.

Dispersion as fine droplets is generally conducted by using a colloid mill, high pressure homogenizer, ultrasonic wave emulsifier, etc., and, as an emulsifying aid, an anionic surfactant is generally used.

Examples of such a surfactant include a formalin condensate of a 55:45 molar ratio of p-nonylphenol to sodium p-nonylphenoxybutylsulfonate (mean condensation degree=3.4), as described in Japanese Patent Appln. (OPI) No. 138726/78, sodium p-tert-octylphenylpolyoxyethylenesulfonate, sodium triisopropylnaphthalenesulfonate, sodium dinonylnaphthalene sulfonate, sodium p-dodecylbenzenesulfonate, sodium salt of dioctyl sulfosuccinate, sodium salt of cetyl sulfate, and anionic sulfactants disclosed in Japanese Patent Publication No. 4293/64 and British Pat. No. 1,138,514. The combined use of these anionic surfactants and anhydrohexytol higher fatty acid esters provides a particularly good emulsifying ability as described in U.S. Pat. No. 3,676,141. Further, useful dispersing methods are disclosed in Japanese Patent Publication No. 13837/68, U.S. Pat. Nos. 2,992,104, 3,044,873, 3,061,428, 3,832,173, etc., which are also effective for dispersing the compounds of the present invention.

Examples of the hydrophilic colloid to be used for dispersing the immobile compound of the present invention include gelatin, colloidal albumin, casein, cellulose derivatives (e.g., carboxymethyl cellulose, hyroxyethyl cellulose, etc.), sugar derivatives (e.g., agar-agar, sodium alginate, starch derivative, etc.), synthetic hydrophilic colloid (e.g., polyvinyl alcohol, poly-N-vinylpyrrolidone, polyacrylic acid copolymer, polyacrylamide, derivative or partially hydrolyzed product thereof, etc.), and the like. If desired, a compatible mixture of two or more of these colloids is used. Of these, gelatin is most preferably used, but may be partly or wholy replaced by a synthetic high molecular weight material.

The image dye-providing compound of the present invention is used in such amount that the molar ratio of silver of the silver halide emulsion associated with the compound to the image dye-providing compound is in the range of from about 50/1 to 0.5/1, and preferably from about 20/1 to 2/1.

Image-receiving element preferably is a mordant layer comprising poly-4-vinylpyridine latex (preferably in polyvinyl alcohol) described in U.S. Pat. No. 3,148,061, polyvinyl pyrrolidone described in U.S. Pat. No. 3,003,872, quaternary ammonium salt-containing polymer as described in U.S. Pat. No. 3,239,337, or the like. As the mordant, basic polymers described in U.S. Pat. Nos. 2,882,156, 3,625,694, 3,709,690, etc. are also effective. Further, mordants described in U.S. Pat. Nos. 2,484,430, 3,271,147, 3,184,309, 3,271,147, etc., are also effective.

Color photographic materials containing the image dye-providing compounds of the present invention preferably have the function of neutralizing alkali to be brought thereinto from a processing composition. The processing solution contains enough alkali for providing a high pH of 8 or more, preferably 10 or more, to accelerate the image-forming step comprising development of silver halide emulsion, dye release and diffusion, etc. Once formation of diffusion transfer image is substantially completed, pH in the film unit is brought to about neutrality, i.e., 9 or less, and preferably 8 or less, to thereby substantially discontinue the image-forming step, thus preventing change of image tone with time and depressing image discoloration or browning to be caused by high alkali and staining of white background. For this purpose it is advantageous to provide in a film unit a neutralizing layer containing an acidic material in an amount sufficient to neutralize the alkali in the processing solution to the pH degree described above, i.e. in an area concentration equivalent to, or more than that, of the alkali in the spread processing solution. Preferable acidic materials are those which have an acidic group of 9 or less in pKa (or a precursor group capable of providing such acidic group by hydrolysis). More preferable examples thereof include higher fatty acids (e.g., oleic acid described in U.S. Pat. No. 2,983,606) and polymers of acrylic acid, methacrylic acid, maleic acid, partially esterified product thereof, and acid anhydride thereof. Specific examples of high molecular acidic material are a copolymer between a vinyl monomer (e.g., ethylene, vinyl acetate, vinyl methyl ether, etc.) and maleic anhydride or n-butyl half ester thereof, a copolymer between butyl acrylate and acrylic acid, cellulose acetate.acidic phthalate, etc. The neutralizing layer may contain such polymer as cellulose nitrate or polyvinyl acetate in addition to the above-described acidic materials, and may contain a plasticizer as described in U.S. Pat. No. 3,557,237. Further, the neutralizing layer may be hardened by cross-linking reaction using a multi-functional aziridine compound, epoxy compound, or the like. The neutralizing layer is provided in an image-receiving element and/or a light-sensitive element. It is particularly advantageous to provide the neutralizing layer between a support of the image-receiving element and an image-receiving layer thereof. The acidic materials may be incorporated in a film unit by micro-encapsulating them as described in West German OLS No. 2,038,254.

In the above-described instance, the neutralizing layer or acidic material-containing layer is desirably spaced from a spread processing solution layer by a neutralization rate-adjusting layer (timing layer). This neutralization rate-adjusting layer functions to delay neutralization of the processing solution by the neutralizing layer, thus allowing desired development and transfer to process sufficiently. Such neutralization rate-adjusting layer comprises a main ingredient of a polymer such as gelatin, polyvinyl alcohol, polyvinyl propyl ehter, polyacrylamide, hydroxypropyl methyl cellulose, isopropyl cellulose, partial polyvinyl butyral, partially hydrolyzed polyvinyl acetate, $\beta$-hydroxyethyl methacrylate-ethyl acrylate copolymer, or the like. These polymers are usefully hardened by a cross-linking reaction using an aldehyde compound such as formaldehyde or an N-methylol compound. Examples of the neutralization rate-adjusting layer are described in U.S. Pat. Nos. 3,455,686, 4,009,030, 3,785,815, Japanese Patent Application (OPI) Nos. 2431/77, 90616/75, 92022/73, 64435/74, 22935/74, 77333/76, Japanese Patent Publication Nos. 15756/69, 12676/71, 41214/73, West German OLS Nos. 1,622,936, 2,162,277, Research Disclosure #15162, No. 151, (1976), etc. The neutralization rate-adjusting layer preferably has a thickness of from $2\mu$ to $20\mu$.

The processing composition to be used in the present invention constituting the processing element is a liquid composition containing processing ingredients necessary for developing a silver halide emulsion and formation of diffusion transfer dye image or dye image remaining after release of dye, in which water is a main solvent and which may optionally contain a hydrophilic solvent such as methanol or 2-methoxyethanol. The processing composition contains alkali in an amount sufficient to maintain the pH at a level suitable for development of the emulsion layer and neutralize acids to be generated during the steps of development and image formation (for example, hydrohalogenic acids like hydrobromic acid). As the alkali, lithium hydroxide, sodium hydroxide, potassium hydroxide, calcium hydroxide dispersion, tetramethylammonium hydroxide, alkali metal or alkaline earth metal salts (e.g., sodium carbonate, trisodium phosphate, etc.), and amines (e.g., dimethylamine, etc.). In the case of a diffusion transfer process, it is desirable to incorporate the caustic alkali in such concentration that the pH of the composition is about 10 or more, and preferably 11 or more, at room temperature. In this instance, the processing composition more preferably contains a hydrophilic polymer such as a high molecular polyvinyl alcohol, hydroxyethyl cellulose or sodium carboxymethyl cellulose. These polymers impart to the processing composition a viscosity of 1 poise or more, and preferably from 500 to 1000 poises, at room temperature, which not only facilitates uniform spreading of the composition upon processing, but also forms a non-flowing film upon concentration of the processing composition due to the migration of the aqueous solvent into the light-sensitive element and the image-receiving element in the course of the processing, thus serving to unify the film unit after the processing. In addition, this polymer film can serve, after the substantial completion of the formation of diffusion transfer image, to control further migration of the coloring ingredients into the image-receiving layer, thereby preventing the image from being changed.

In some cases, the processing composition advantageously contains a light absorbent such as carbon black and a desensitizer as described in U.S. Pat. No. 3,579,333 so as to prevent the silver halide emulsion from being fogged by stray light from outside during processing.

The compounds of the general formula given in this invention can be generally synthesized by reacting an azo dye sulfonyl chloride with a variety of aminophenols or aminonaphthols having an organic ballast group and a nucleophilic group. Processes for synthesizing the dye moiety and the sulfonyl chloride derivatives thereof are described in Japanese Patent Application (OPI) Nos. 12581/73, 33826/73, 114424/74, and 126332/74.

Synthesis Examples of several specific compounds and Examples of elements of the present invention will now be described below, but such example do not limit the present invention in any way.

EXAMPLE 1

Synthesis of Compound (3)

(a) Synthesis of 1-acetoxy-5-acetaminonaphthalene-2-sulfonic acid 140 g of 5-amino-1-naphthol-2-sulfonic acid synthesized according to the process described in U.S. Pat. No. 3,954,476 was heated to 80°–90° C. for about 30 minutes while stirring together with 700 ml of acetic anhydride and 50 g of sodium acetate. Then, the reaction solution was allowed to cool to room temperature, and precipitated crystals were collected by filtration, washed with about 2 liters of acetone, and dried to obtain 205 g of product (containing about 20% sodium acetate). Yield: 87%

(b) Synthesis of 1-acetoxy-5-acetaminonaphthalene-2-sulfonyl chloride 100 g of 1-acetoxy-5-acetaminonaphthalene-2-sulfonic acid was added to 500 ml of sulfolane, and 200 ml of phosphorus oxychloride was dropwise added thereto at 40° C. while stirring. After continuing stirring for about 1 hour, the reaction mixture was poured into 2 liters of ice-water, and the precipitated crystals were collected by filtration, washed with water until the filtrate did not show acidity, and air-dried as such for 24 hours to obtain 70 g (81% yield) of product.

(c) Synthesis of 5-amino-2-hexadecylsulfamoyl-1-naphthol 30 g of hexadecylamine was dissolved in 250 liters of acetone. To this solution was added gradually a solution of 40 g of 1-acetoxy-5-acetamino-naphthalene-2-sulfonyl chloride synthesized above in 150 ml of acetone while stirring, and, after completion of the addition, stirring was continued for about one hour at about 40° C. Then, the reaction solution was ice-cooled, and the precipitated crystals were collected by filtration and well washed with 1 liter of methanol. The crystals were refluxed for 8 hours together with 200 ml of ethanol, 30 g of NaOH, and 100 ml of water. After being allowed to cool to room temperature, the solution was neutralized with acetic acid, and the crystals thus precipitated were collected by filtration and recrystallized from an ethanol-water mixture solvent to obtain 22 g (54% yield) of product.

(d) Synthesis of 5-sulfamoylamino-2-hexadecylsulfamoyl-1-naphthol 18 g of 5-amino-2-hexadecylsulfamoyl-1-naphthol obtained above was dissolved in 100 ml of acetone, 12 ml of pyridine was added thereto and, under stirring, 12 ml of sulfamoyl chloride was added thereto followed by stirring the solution for about 2 hours. This reaction solution was then poured into 1 liter of dilute hydrochloric acid, and the crystals thus precipitated were collected by filtration and dried. Recrystallization of the crystals from ethanol gave 15 g (71% yield) of product.

(e) Synthesis of 5-sulfamoylamino-2-hexadecylsulfamoyl-4-(4'-sulfophenylazo)-1-naphthol 5 g of sulfanilic acid was dissolved in 40 ml of water containing 2 g of sodium carbonate, 5 ml of water containing 2.2 g of sodium nitrite was added thereto at 10° C. or less, and, while stirring, 50 g of ice was added thereto, followed by further adding thereto 8 ml of concentrated hydrochloric acid to prepare a diazo solution.

On the other hand, 5-sulfamoylamino-2-hexadecylsulfamoyl-1-naphthol obtained above was suspended in 100 ml of ethanol, and 150 ml of water containing dissolved therein 1.8 g of potassium hydroxide was added thereto followed by cooling with ice. To this coupler solution was added the previously prepared diazo solution at 5° to 10° C. under stirring. After leaving the solution for 30 minutes, a magenta-color dye was collected by filtration. This was used in an as-produced form without purification in the subsequent reaction.

(f) Synthesis of 5-sulfamoylamino-2-hexadecylsulfamoyl-4-amino-1-naphthol

The above-described dye was dissolved in 300 ml of hot water, and hot water containing 40 g of sodium hydrosulfite was added thereto. The color of the solution momentarily disappeared to form an oily precipitate, which was ice-cooled, and the so solidified product was collected by filtration. Yield: 10 g (65%).

(g) Synthesis of Compound (3)

10 g of 5-sulfamoylamino-2-hexadecylsulfamoyl-4-amino-1-naphthol and 11.7 g of a dye sulfamoyl chloride were reacted with each other in a mixture of 100 ml of dimethylacetamide (DMAC) and 20 ml of pyridine. After continuing stirring for about 1 hour, the reaction solution was poured into 1 liter of dilute acetic acid, and the crystals thus formed were collected by filtration, dried, and subjected to silica gel column chromatography to purify using a mixed solvent of chloroform-methanol (10:1) as an eluent. Yield: 11.0 (52%).

EXAMPLE 2

Test of Dye-Releasing Ability

For confirming substantial dye-releasing ability of the compound of the present invention, compound (A) of the present invention and compound (B) outside the scope of the invention having no nucleophilic groups were synthesized in an analogous manner to that in Example 1, and the reaction rate was traced respect to each compound.

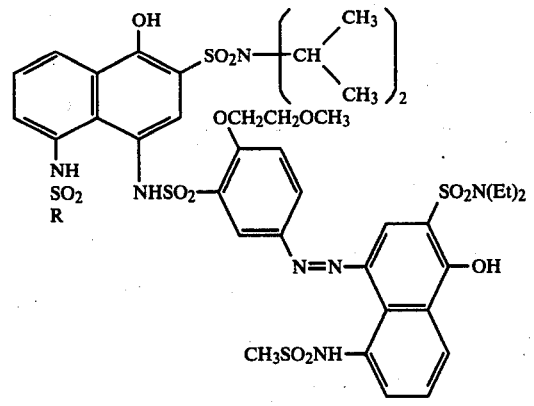

(A): R = $NH_2$
(B): R = $CH_3$ 30 mg portions of compounds (A) and (B), respectively, were dissolved in 15 ml of an aqueous solution of pH 9 (buffer solution of pH 9.00) and in 15 ml of 1 N NaOH aqueous solution in a nitrogenous atmosphere while stirring, then 60 mg of manganese dioxide was added thereto to determine a released dye with time. The results thus obtained are shown in Table 1, from which it is clear that the compound of the present invention showed a reaction rate of from 2 to 14 times as fast as that of the compound having no intramolecular nucleophilic groups, with the difference being particularly remarkable in the pH range of about 9.00.

TABLE 1

| | pH 9.00 | 1N NaOH |
|---|---|---|
| kA | 0.71 $sec^{-1}$ | 0.73 $sec^{-1}$ |
| kB | 0.05 $sec^{-1}$ | 0.34 $sec^{-1}$ |
| kA/kB | 14.2 | 2.15 |

EXAMPLE 3

Test of Photographic Properties

On a transparent polyester support were coated in sequence the following layers to prepare a light-sensitive element.

(1) A layer containing a yellow image dye-providing compound (Compound No. 5) of the present invention (0.54 g/$m^2$), tricyclohexyl phosphate (0.16 g/$m^2$), and gelatin (2.0 g/$m^2$).

(2) A layer containing a blue-sensitive, internal latent image-forming, direct reversal silver bromide emulsion (0.80 g silver/$m^2$), gelatin (0.8 g/$m^2$), the following nucleating agent (0.04 mg/$m^2$), and sodium pentadecylhydroquinonesulfonate (0.05 g/$m^2$):

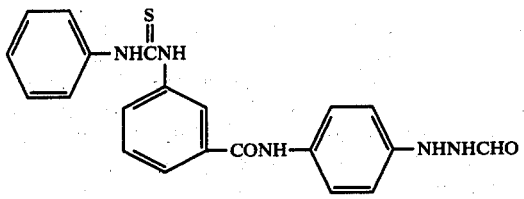

(3) A layer containing gelatin (1.1 g/$m^2$).

A rupturable container was filled with 0.8 g of a processing solution of the following formulation:

| Processing solution | |
|---|---|
| 1-Phenyl-4-hydroxymethyl-4-methyl-3-pyrazolidinone | 13 g |
| Methylhydroquinone | 0.3 g |
| 5-Methylbenzotriazole | 3.5 g |
| Sodium sulfite (anhydrous) | 0.2 g |
| Sodium salt of carboxymethyl cellulose | 58 g |
| Potassium hydroxide (28% aq. soln.) | 200 cc |
| Benzyl alcohol | 1.5 cc |
| $H_2O$ | 685 cc |

On a transparent polyester support was coated a mordant layer containing the following mordant (3.0 g/m$^2$) and gelatin (3.0 g/m$^2$) to prepare an image-receiving element.

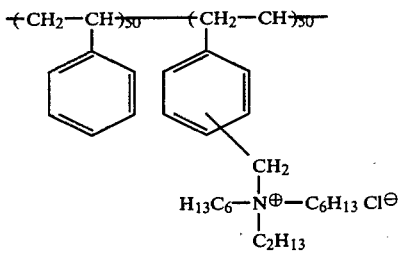

After imagewise exposure of the above-described light-sensitive element, it was unified with the rupturable container containing the above-described processing solution and the image-receiving element, and the processing solution was spread in a thickness of 80 μm at 15° C. and at 25° C. by means of pressure-applying members. After 5 minutes, the image-receiving element was delaminated, dipped in a 2% acetic acid solution, washed with water, and dried to obtain a transferred color image. Blue light reflection density of the yellow dye image diffusion-transferred onto the image-receiving element was measured to obtain the good results of a 1.44 maximum transfer density and a 0.22 minimum transfer density.

EXAMPLE 4

As a result of conducting the same procedures as in Example 3, except for using compounds (2), (3), and (9), respectively, in place of compound (5), similarly good photographic properties were obtained in every case.

EXAMPLE 5

When the same procedures as in Example 3 and 4 were conducted, except for changing the developing agent in the processing formulation to 1-p-tolyl-4-hydroxymethyl-4-methyl-3-pyrazolidinone (6.9 g), maximum transfer density was attained in a shorter time.

EXAMPLE 6

On a transparent polyester support were coated in sequence the following layers to prepare a light-sensitive sheet (comprising a light-sensitive element and an image-receiving element unified therewith).

(1) A mordant layer containing the same mordant (3.0 g/m$^2$) as in Example 3 and gelatin (3.0 g/m$^2$).
(2) A white, reflecting layer containing titanium dioxide (20 g/m$^2$) and gelatin (2.0 g/m$^2$).
(3) An opaque layer containing carbon black (2.70 g/m$^2$) and gelatin (2.70 g/m$^2$).
(4) The same layer as layer (1) in Example 3.
(5) The same layer as layer (2) in Example 3.
(6) The same layer as layer (3) in Example 3.

0.8 g of a processing solution having the same formulation as in Example 3 except for containing 150 g of carbon black was filled in a rupturable container.

On a transparent polyester support were coated in sequence the following layers to prepare a cover sheet.

(1) A layer containing a copolymer of acrylic acid and butyl acrylate (80:20 by weight) (22 g/m$^2$) and 1,4-bis(2,3-epoxypropoxy)butane (0.44 g/m$^2$).
(2) A layer containing acetyl cellulose (producing 39.4 g of acetyl group from 100 g of acetyl cellulose as a result of hydrolysis) (3.8 g/m$^2$), a copolymer of styrene and maleic anhydride (60:40 by weight; molecular weight: about 50,000)(0.2 g/m$^2$), and 5-(β-cyanoethylthio)-1-phenyltetrazole (0.115 g/m$^2$).
(3) A layer containing a latex of vinylidene chloride-methyl acrylate-acrylic acid terpolymer (85:12:3 by weight)(2.5 g/m$^2$) and polymethyl methacrylate latex (particle size: 1 to 3 μm)(0.05 g/m$^2$).

After imagewise exposure, the above-described light-sensitive sheet was unified with a container retaining the aforesaid processing solution and a cover sheet, and the processing solution was spread in a thickness of 80 μm at 25° C. by means of a pressure-applying member to obtain a transfer color image.

EXAMPLE 7

On a transparent polyester support there were coated, in sequence, the following layers to prepare a light-sensitive sheet.

(1) The same mordant layer as layer (1) in Example 6.
(2) The same white reflecting layer as layer (2) in Example 6.
(3) The same opaque layer as layer (3) in Example 6.
(4) A layer containing the foregoing compound (11) [cyan image dye-prodviding compound] (0.50 g/m$^2$), tricyclohexyl phosphate (0.09 g/m$^2$), and 2,5-di-t-pentadecylhydroquinone (0.008 g/m$^2$).
(5) A layer containing a red-sensitive, internal latent image-forming, direct reversal silver bromide emulsion (1.30 g silver/m$^2$), gelatin (1.2 g/m$^2$), the same nucleating agent as in Example 3 (0.05 g/m$^2$), and sodium pentadecylhydroquinonesulfonate (0.13 g/m$^2$).
(6) A layer containing 2,5-di-t-pentadecylhydroquinone (0.71 g/m$^2$), vinylpyrrolidone-vinyl acetate copolymer (7:3 in molar ratio)(0.24 g/m$^2$), and gelatin (0.6 g/m$^2$).
(7) A layer containing gelatin (0.4 g/m$^2$).
(8) A layer containing the foregoing compound (9) [magenta image dye-providing DRR compound] (0.45 g/m$^2$), tricyclohexyl phosphate (0.08 g/m$^2$), 2,5-di-t-pentadecylhydroquinone (0.009 g/m$^2$), and gelatin (0.9 g/m$^2$).
(9) A layer containing a green-sensitive, internal latent image-forming, direct reversal silver bromide emulsion (0.82 g silver/m$^2$), gelatin (0.9 g/m$^2$), the same nucleating agent as in layer (5) (0.03 mg/m$^2$), and sodium pentadecylhydroquinonesulfonate (0.08 g/m$^2$).
(10) A layer containing 2,5-di-t-pentadecylhydroquinone (0.71 g/m$^2$), vinylpyrrolidone-vinyl acetate copolymer (7:3 in molar ratio) (0.24 g/m$^2$), and gelatin (0.6 g/m$^2$).

(11) A layer containing 0.4 g/m$^2$ gelatin

(12) A layer containing the foregoing compound (5) [yellow image dye-providing compound] (0.50 g/m$^2$), tricyclohexy phosphate (0.13 g/m$^2$), 2,5-di-t-pentadecylhydroquinone (0.014 g/m$^2$), and gelatin (0.7 g/m$^2$).

(13) A layer containing a blue-sensitive, internal latent image-forming, direct reversal silver bromide emulsion (1.09 g silver/m$^2$), gelatin (1.1 g/m$^2$), the same nucleating agent as in layer (5) (0.04 mg/m$^2$), and sodium pentadecylhydroquinonesulfonate.

(14) A layer containing gelatin (1.0 g/m$^2$).

After imagewise exposure, the above-described light-sensitive sheet was unified with a container retaining the same processing solution as in Example 6 and the same cover sheet as in Example 6, and the processing solution was spread in a thickness of 80 $\mu$m at 25° C. using a pressure-applying member to obtain a transfer color image which had a satisfactory maximum reflection density, satisfactory minimum reflection density, and good gradation.

The color diffusion transfer light-sensitive element to be used in the present invention contains silver halide emulsions associated with image dye-providing compounds.

The silver halide emulsion to be used in the present invention is a hydrophilic colloidal dispersion of silver chloride, silver bromide, silver chlorobromide, silver bromoiodide, silver chlorobromoiodide or the mixture thereof. The halide component(s) is (are) selected depending upon the purpose for the end-use of the light-sensitive material and the processing conditions. In particular, a silver bromide emulsion, silver bromoiodide emulsion or silver bromochloroiodide emulsion containing not more than 10 mole % iodide (and preferably not more than 30 mole % chloride) and balance bromide is desirable. Silver halide grains may be either of ordinary grain size or of fine grain size, but silver halide grains having a mean particle size of about 0.1$\mu$ to about 2$\mu$ are preferable. Further, in some purposes for the end-use of the light-sensitive material, silver halides having a uniform grain size are desirable. The grains can be in a cubic form, an octahedral form, or in a mixed crystal form. These silver halide emulsions can be prepared according to the known conventional processes as described, e.g.m in P. Glafkides, *Chimie Photographique* (2nd, Ed., 1957, Paul Montel, Paris), chapters 18 to 23.

The silver halide emulsions to be used in the present invention are preferably subjected to chemical sensitization using a natural sensitizer contained in gelatin, a sulfur sensitizer such as sodium thiosulfate or N,N,N'-trimethylthiourea, a gold sensitizer such as a thiocyanate complex salt or thiosulfate complex salt of monovalent gold, or a reducing sensitizer such as stannous chloride or hexamethylenetetramine.

Emulsions which are liable to form latent image on the surface of the silver halide grains, direct reversal silver halide emulsions using desensitizing dyes, and solarization type silver halide emulsions are usable for the present invention, as well as internal latent image-forming silver halide emulsions as described in U.S. Pat. Nos. 2,592,550, 3,206,313, etc.

As the above-described solarization type silver halide emulsions, those described in The Theory of the Photographic Process edited by James, pp. 261–297 are useful. Processes for their preparation are described in, for example, British Pat. Nos. 443,245, 462,730, U.S. Pat. Nos. 2,005,837, 2,541,472, 3,367,778, 3,501,305, 3,501,306, 3,501,307, etc.

Internal latent image-forming silver halide emulsions advantageously used in the present invention are emulsions which have light-sensitive centers mainly within silver halide grains, and in which, upon exposure, latent images are selectively formed there, with the degree of the latent image formation being lower on the grain surface. According to the description in The *Theory of Photographic Process*, (4th Ed., 1977, edited by James), pp. 171 to 176, such internal latent image-forming silver halide emulsions are characterized in that the amount of silver obtained by developing them with a surface developer after imagewise exposure (corresponding to surface latent image) is distinctly less than the amount of silver obtained by using an internal developer (corresponding to the whole latent image). Internal latent image-forming silver halide emulsions can be prepared by various processes. For example, there are Burton's emulsions of a high iodide content prepared by an ammoniacal process [E. J. Wall; *Photographic Emulsions*, pp. 35–36 and 52–53] (American Photographic Publishing Co. (1929), and U.S. Pat. Nos. 2,497,875 an 2,563,785); large-sized primitive emulsions of a low iodide content prepared by an ammoniacal process (West German OLS No. 2,728,108); emulsions prepared by rapidly decreasing the ammonia concentration of a silver halide-ammonia complex salt solution to precipitate silver halide-ammonia complex salt solution to precipitate silver halide grains (U.S. Pat. No. 3,511,662); conversion emulsions prepared according to catastrophic precipitation process by first forming silver salt grains of relatively high solubility, such as silver chloride, then converting them to silver salt grains of a low solubility such as silver bromide or silver bromoiodide (U.S. Pat. No. 2,592,250); core-shell type emulsions comprising core particles having coated thereon a silver halide shell, prepared by mixing a chemically sensitized large-sized core emulsion with a fine-grained emulsion followed by ripening (U.S. Pat. No. 3,206,313 and British Pat. No. 1,011,062); core-shell type emulsions prepared by adding, to a chemically sensitized mono-disperse core emulsion, a soluble silver salt solution and a soluble silver halide emulsion at the same time while maintaining the silver ion concentration constant, to thereby cover core particles with a shell of silver halide (British Pat. No. 1,027,146 and U.S. Pat. No. 3,761,276); halogen-localized emulsions containing emulsion grains of two or more layered structure with the layers being different from each other in halogen composition (U.S. Pat. No. 3,935,014); emulsions prepared by producing silver halide grains in an acidic medium containing a trivalent metal ion to incorporate different metal therein (U.S. Pat. No. 3,447,927); and the like.

As a fogging agent (nucleating agent) for this type of emulsion, hydrazines as described in U.S. Pat. Nos. 2,588,982 and 2,563,785, hydrazines and hydrazones as described in U.S. Pat. No. 3,227,552, and quaternary salt compounds as described in British Pat. No. 1,283,835, Japanese Patent Publication No. 38164/74, U.S. Pat. Nos. 3,734,738, 3,719,494, 3,615,615, etc. are typical examples.

Further, DIR reversal emulsion systems as described in U.S. Pat. Nos. 3,227,551, 3,227,554, and 3,364,022 or reversal emulsion systems based on solution physical development as described in British Pat. No. 904,364 can be associated with the image dye-providing compounds of the present invention.

The silver halide emulsions to be used in the present invention may be stabilized with such additives as 4-hydroxy-6-methyl-1,3,3a,7-tetraazaindene, 5-nitrobenzimidazole, 1-phenyl-5-mercaptotetrazole, 8-chloromercuriquinoline, benzenesulfinic acid, pyrocatechin, 4-methyl-3-sulfoethylthiazolidine-2-thione, 4-phenyl-3-sulfoethylthiazolidine-2-thione, etc. In addition, inorganic compounds such as cadmium salts, mercury salts, complex salts of platinum group metals such as a chlorine complex salt of palladium, and the like are also useful for stabilizing the light-sensitive material of the present invention. Furthermore, the silver halide emulsions to be used in the present invention may contain sensitizing compounds such as a polyethylene oxide compound.

The silver halide emulsions to be used in the present invention can possess, if desired, color sensitivity expanded by using spectral sensitizing dyes. As the useful spectrally sensitizing agents, there are cyanines, merocyanines, holopolar cyanines, styryls, hemicyanines, oxanols, hemioxanols, and the like. Specific examples of spectrally sensitizing agents are described in the aforesaid book by P. Glafkides, chapters 35 to 41, and F. M. Hamer; *The Cyanine Dyes and Related Compounds* (Interscience) (1964). In particular, cyanines in which a nuclear nitrogen atom in a basic hetero ring nucleus is substituted by an aliphatic group (e.g., an alkyl group) having a hydroxy group, a carboxy group or a sulfo group, e.g., those described in U.S. Pat. Nos. 2,503,776, 3,459,553 and 3,177,210 are especially useful for the practice of the present invention.

The light-sensitive element of the photographic light-sensitive material of the present invention is coated on a planar substance which does not undergo serious dimensional change due to the processing composition during processing; for example, cellulose acetate film, polystyrene film, polyethylene terephthalate film, polycarbonate film, the laminate thereof, and thin glass films can be used.

If the adhesion force between the support and the photographic emulsion layer is insufficient, there is provided as a subbing layer an adhesive layer having adhesiveness for both the support and the photographic emulsion layer. Also, in order to further improve the adhesion properties, the surface of the support may be subjected to preliminary processings such as corona discharge, irradiation with UV rays, flame treatment, etc.

As the support, paper and paper surface-laminated with a water-impermeable polymer (such as polyethylene) can be used.

The immobile compounds of the present invention may be used for ordinary light-sensitive materials, but, they are particularly useful for color disfusion transfer light-sensitive materials. For such use, processes for forming a layered structure of light-sensitive material described in Japanese Patent Publication No. 16356/71, Japanese Patent Application (OPI) No. 33630/76, and U.S. Pat. No. 3,594,164 can be used as well.

In the color light-sensitive element to which the present invention is applicable, an image dye-providing compound is associated with a silver halide emulsion. The combination of the color sensitivity of the silver halide emulsion and the spectral absorption of the dye image is properly selected depending upon the intended color reproduction. In the reproduction of natural colors according to subtractor color photography, a light-sensitive element having at least two combinations of emulsions having selective spectral sensitivity in certain wave-length region and image dye-providing compounds having selective spectral absorption in the same wavelength region is used. In particular, a light-sensitive element having the combination of a blue-sensitive silver halide emulsion and a yellow image dye-providing compound, the combination of a green-sensitive emulsion and a magenta image dye-providing compound, and the combination of a red-sensitive emulsion and a cyan image dye-providing compound is useful. These combination units of emulsions and image dye-providing compounds are coated as layers in face-to-face alignment or coated as one layer by forming each into particles and mixing them. In a preferable multi-layered structure, there are positioned, in sequence from the side to be exposed, a blue-sensitive emulsion combination unit, a green-sensitive emulsion combination unit, and a red-sensitive emulsion combination unit. In the case of high speed emulsions containing silver iodide, a yellow filter layer may preferably be provided intermediate the blue-sensitive emulsion combination unit and the green-sensitive emulsion combination unit. This yellow filter layer contains a yellow colloidal silver dispersion, an oil-soluble yellow dye dispersion, an acidic dye mordanted to a basic polymer, or a basic dye mordanted to an acidic polymer. The emulsion layers are advantageously spaced from each other by an interlayer. The interlayer prevents unfavorable chemical reactions occurring between emulsion combination units having different color sensitivities. The interlayer is constituted, for example, by a polymer containing fine pores formed by a latex of hydrophilic polymer and hydrophobic polymer described in U.S. Pat. No. 3,625,685 or a polymer whose hydrophilicity is to be gradually increased by the processing composition, such as calcium alginate, described in U.S. Pat. No. 3,384,483, as well as a hydrophilic polymer such as gelatin polyacrylamide, partially hydrolyzed product of polyvinyl acetate, etc. Further, a spacer layer (e.g., gelatin layer) may be provided between the interlayer and the image dye-providing compound-containing layer to thereby prevent the image dye-providing compound itself from migrating into the interlayer to spoil it.

In order to prevent an oxidation product of a developing agent from diffusing into other emulsion combination unit of different color sensitivity, compounds functioning to capture such oxidation product (e.g., color mixing-preventing agents such as 2,5-di(sec-dodecyl)hydroquinone, 2,5-di(tert-pentadecyl)hydroquinone, etc.) may be incorporated.

While the invention has been described in detail and with reference to specific embodiments thereof, it will be apparent to one skilled in the art that various changes and modifications can be made therein without departing from the spirit and scope thereof.

What is claimed is:

1. A photographic element comprising a support having provided thereon at least one light sensitive silver halide emulsion layer, said silver halide emulsion layer containing a compound represented by formula (I)

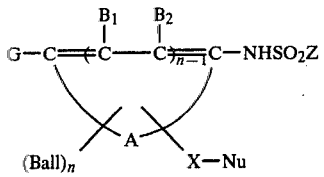

(I)

wherein G represents —$OR^1$ or —$NHR^2$, $R^1$ represents hydrogen or a hydrolyzable moiety, $R^2$ represents hydrogen or an alkyl group containing from 1 to 50 carbon atoms, Z represents a photographically useful group, A represents an atomic group forming an aromatic ring, Ball represents an organic immobilizing group on the aromatic ring, which contains from 8 to 50 carbon atoms, m represents an integer of 1 or 2, X represents a divalent group, Nu represents a nucleophilic group, and n represents an integer of 1 or 2, and X with said nucleophilic group Nu is capable of forming a 5- or 12-membered ring by oxidation having an electrophilic center at the carbon atom substituted by the —$NHSO_2Z$ group and $B_1$ and $B_2$ each represents hydrogen or a substituent selected from the group consisting of an alkyl group containing from 1 to 7 carbon atoms.

2. A photographic element as in claim 1, wherein Z represents an image dye-providing moiety.

3. A photographic element as in claim 1 comprising a support having provided thereon a red-sensitive silver halide emulsion-containing layer associated with a compound according to Formula (I) having a cyan image-providing moiety, a green-sensitive silver halide emulsion-containing layer associated with a compound according to Formula (I) having a magenta image-providing moiety, and a blue-sensitive silver halide emulsion-containing layer associated with a compound according to Formula (I) having a yellow image-forming moiety.

4. A photographic element as in claim 1, wherein $R^2$ represents hydrogen or an alkyl group containing from 1 to 18 carton atoms, Z represents a photographically useful group selected from an image-dye providing moiety, a bleaching accelerator, a bleaching-restrainer, a developing agent, a silver halide solvent, a fixing agent, a toner, a hardening agent, a chemical sensitizing agent, a spectral sensitizing agent, and antifogging agent, a development strainer, a development accellerator, and a silver halide-fogging agent; Ball represents an organic immobilizing group containing from 8 to 50 atoms; and Nu represents a nucleophilic group selected from a hydroxy group, an amino group, a carboxylic group, a sulfonic acid group, and precursors thereof.

5. A photographic element as in claim 4, wherein Z represents an image dye-providing moiety.

6. A photographic element as in claim 4, wherein the immobilizing group is selected from the Formulae

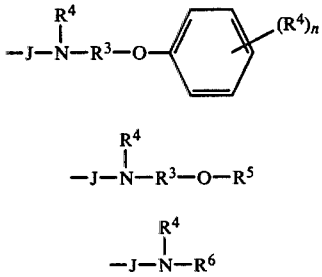

-continued

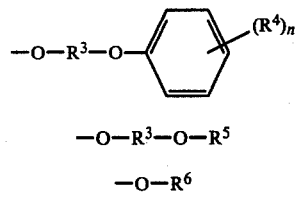

wherein J represents —CO— or —$SO_2$—, $R^3$ represents an alkylene group containing from 1 to 10 carbon atoms, $R^4$ represents hydrogen or an alkyl group containing from 1 to 30 carbon atoms, n represents antinteger of 1 to 5, $R^5$ represents an alkyl group containing from 4 to 30 carbon atoms, and $R^6$ represents an unsubstituted alkyl group containing from 8 to 30 carbon atoms.

7. A photographic elements as in claim 5, wherein the immobilizing group is selected from the Formulae

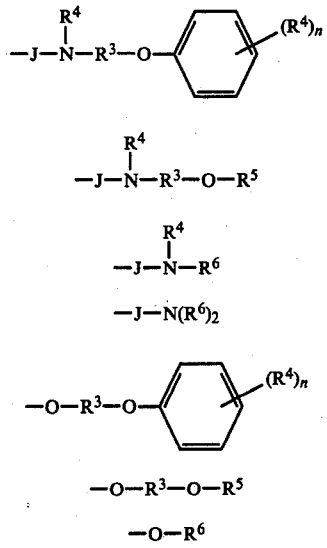

wherein J represents —CO— or —$SO_2$—, $R^3$ represents an alkylene group containing from 1 to 10 carbon atoms, $R^4$ represents hydrogen or an alkyl group containing from 1 to 30 carbon atoms, n represents antinteger of 1 to 5, $R^5$ represents an alkyl group containing from 4 to 30 carbon atoms, and $R^6$ represents unsubstituted alkyl group containing from 8 to 30 carbon atoms.

8. A photographic elements as in claim 1, wherein a compound according to Formula (I) is represented by the Formula (II)

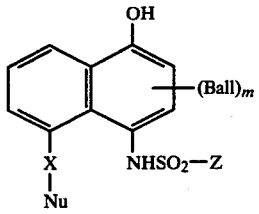

(II)

wherein Z, X, Nu, Ball, m are the same as defined for Formula (I).

9. A photographic element as in claim 1, wherein a compound according to Formula (II) is represented by the Formula (III)

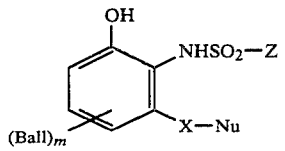

(III)

wherein Z, X, Nu, Ball and m are the same as defined for Formula (I).

10. A photographic element as in claim 1, wherein Z represents an image dye-providing moiety and the molar ratio of silver in the silver halide emulsion associated with the compound according to Formula (I) is in the range of from about 50/1 to 0.5/1.

11. A photographic element as in claim 1, wherein Z represents an image dye-providing moiety and the molar ratio of silver in the silver halide emulsion associated with the compound according to Formula (I) is in the range of from about 20/1 to 2/1.

12. A photographic element as in claim 1, wherein $R^2$ represents hydrogen or an alkyl group containing from 1 to 18 carbon atoms.

13. A photographic element as in claim 1, wherein X represents a divalent group selected from a $C_1$–$C_8$ methylene group, an oxamethylene group, an aminomethylene group, a sulfonyl group, a carbonyl group, an amido group, a carbonyl group, a sulfonamido group, a sulfamoyl group, a phenylene group.

* * * * *